United States Patent [19]

Stickney

[11] 4,235,181

[45] Nov. 25, 1980

[54] AUTOMATIC BLOWER CONTROL SYSTEM FOR INBOARD MARINE ENGINES

[75] Inventor: Donald B. Stickney, Milwaukie, Oreg.

[73] Assignee: Oregon Link, Inc., Portland, Oreg.

[21] Appl. No.: 900,438

[22] Filed: Apr. 27, 1978

Related U.S. Application Data

[63] Continuation-in-part of Ser. No. 766,929, Feb. 9, 1977, abandoned.

[51] Int. Cl.[3] ..... B63J 2/06

[52] U.S. Cl. ..... 114/211; 98/1; 123/198 D; 307/9; 340/527; 340/661

[58] Field of Search ..... 114/211; 115/76; 98/1; 307/9; 123/102, 122 H, 198 D, 179 H; 361/239, 240, 242; 340/527, 530, 661, 662; 180/105 E, 271

[56] References Cited

U.S. PATENT DOCUMENTS

| | | | |
|---|---|---|---|
| 3,465,665 | 9/1969 | O'Day et al. | 98/1 |
| 3,601,103 | 8/1971 | Swiden | 123/102 |
| 3,828,742 | 8/1974 | Weis | 123/102 |
| 3,884,203 | 5/1975 | Cliffgard | 123/102 X |
| 3,948,202 | 4/1976 | Yoshikawa | 114/211 |

*Primary Examiner*—Sherman D. Basinger
*Attorney, Agent, or Firm*—Robert F. Van Epps

[57] ABSTRACT

A control system for automatic actuation of an exhaust blower associated with an internal combustion inboard marine engine. The control system includes a starter interlock circuit which prevents engine starting for a predetermined period of time to allow the blower to exhaust explosive fumes from the engine compartment and a low speed actuation circuit which operates in response to detection of engine speed below a predetermined level to actuate the exhaust blower. Also included is a emergency override of the starter interlock circuit.

7 Claims, 2 Drawing Figures

AUTOMATIC BLOWER CONTROL SYSTEM FOR INBOARD MARINE ENGINES

BACKGROUND OF THE INVENTION (1) Related Application Data

This application is a continuation-in-part of copending application Ser. No. 766,929 filed on Feb. 9, 1977 now abandoned.

(2) Field of the Invention

The present invention relates to control systems and more particularly to an automatic system for actuating an exhaust blower associated with an internal combustion inboard marine engine prior to starting and during low speed operation.

(3) Description of the Prior Art

In a typical inboard engine motorboat where the engine is enclosed in a compartment an exhaust blower is provided to remove fuel vapors and prevent their buildup to volatile levels. Such exhaust blowers are generally manually actuated prior to starting the engine. With increased recreational use of such motorboats it has become evident that an increasingly frequent cause of personal injury and boat destruction is by explosion or fire resulting from inadequate attention to proper use of the exhaust blower prior to starting the engine or while operating at low speeds such that normal airflow is inadequate to clear the engine compartment. A considerable advantage would thus be afforded if the exhaust blower operation were automated under these hazardous conditions.

The pre-ignition condition was recognized in U.S. Pat. No. 3,675,034 wherein there is disclosed a blocking circuit for use in the ignition system of an inboard marine engine and having a self-destruct manual override switch. That circuit is inserted in the ignition circuit and blocks the application of the battery voltage to the ignition circuit during a delay period unless the manual override is activated. Thus the engine will not operate. Two distinct problems attend this approach; first in the event of a circuit failure the engine will not operate unless the override is actuated. The override, however, is a self-destruct type of device which, once activated cannot be reactivated. Second, there is no way to test the override function since once the switch is activated it must be physically removed.

The above-referenced patent does not address the problem of fume build-up under low speed operating conditions. Numerous engine control systems have been devised which monitor engine speed and adjust engine operation upon detection of an overspeed or underspeed condition. Typical of such systems are those disclosed in U.S. Pat. Nos. 3,828,742; 3,617,879; 3,884,203 and 3,601,103. None of these references are, however, directed to the automatic actuation of auxiliary apparatus in general or to the inboard marine engine environment.

OBJECTS AND SUMMARY OF THE INVENTION

From the preceding discussion it will be understood that among the various objectives of the present invention are included:

- the provision of a new and improved circuit for the automatic actuation of an exhaust blower associated with an internal combustion inboard marine engine;

- the provision of a circuit of the above-described character which prevents starting of said engine until said blower has been operated for a predetermined time but which will not interfere with the operation of said engine once started;
- the provision of a circuit of the above-described character which automatically actuates said blower when said engine is operated below a predetermined speed; and
- the provision of a circuit of the above-described character including a provision for manual override of the starting prevention circuit in emergency situations.

These and other objectives of the present invention are efficiently met by providing a first set of normally open relay contacts connected in series with the starter solenoid circuit. The relay coil is driven by the output of a solid state timing circuit which is actuated together with the exhaust blower when the exhaust blower switch is closed. After the blower has operated for a predetermined period of time current is applied to the relay coil, closing the contacts and thus applying power to the conventional starter solenoid circuit. Once the engine is started the speed of the engine is monitored and a signal generated to automatically actuate the exhaust blower at any time that the engine speed is lower than a predetermined threshold.

The foregoing as well as other objects features and advantages of the present invention will be more clearly understood from the following detailed description taken in conjunction with the appended drawings.

DESCRIPTION OF THE PREFERRED EMBODIMENT

Figure 1:
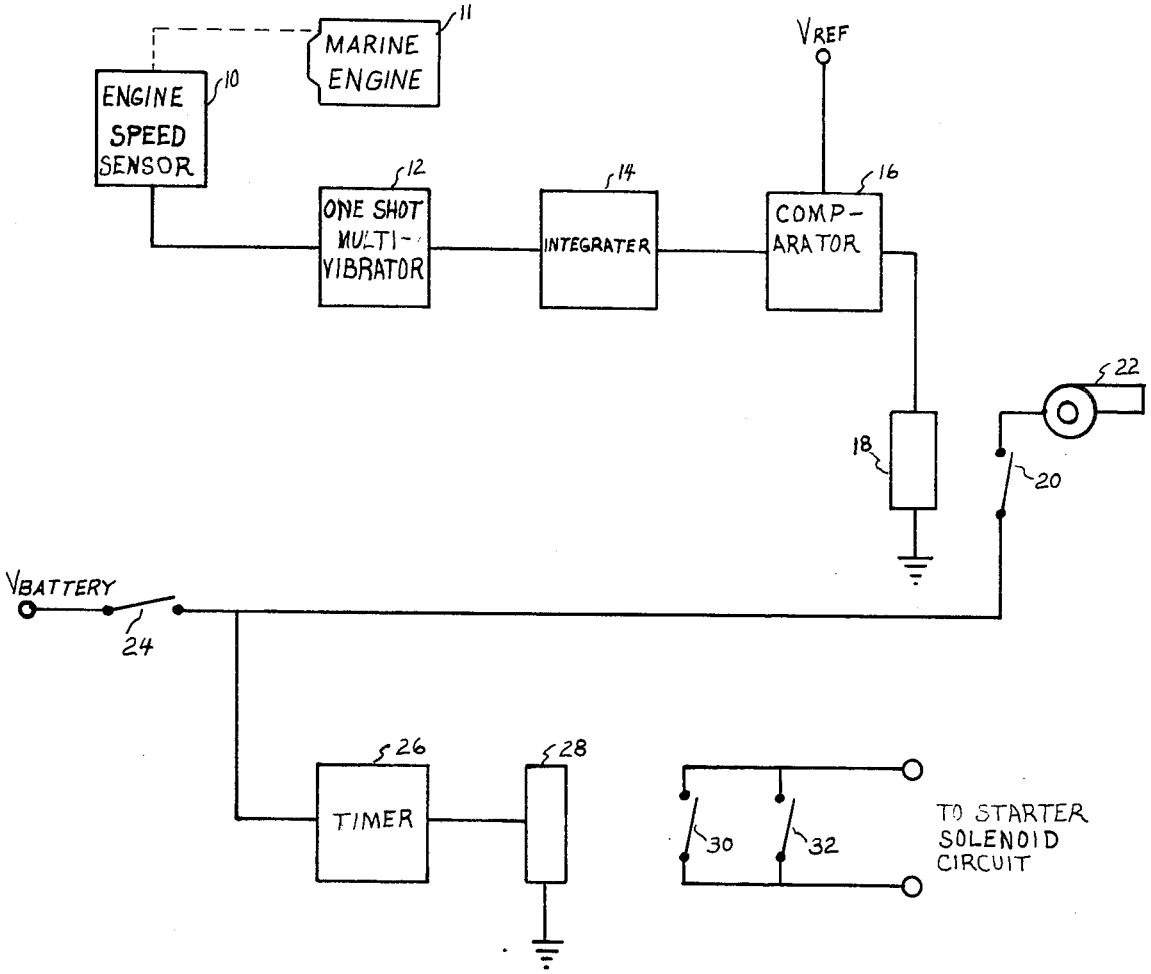
FIG. 1 is a simplified block diagram of the automatic blower control system of the present invention.

With reference now to FIG. 1 the control system of the present invention includes an engine speed sensor 10 such as a pick-off from the conventional ignition coil primary winding or distributor points of a gasoline engine 11 or a magnetic pick-up located on the crankshaft of a diesel engine. A one shot multivibrator 12 is coupled at its input to the speed sensor 10 and has a presettable pulse width of from one to three milliseconds depending upon the nature of the speed sensor output signal which is determined by the number of engine cylinders and maximum engine RPM.

In response to signals received from the associated speed sensor 10 the one-shot multivibrator 12 produces an output pulse train with fixed pulse amplitude and pulse width, but with the pulse frequency directly proportional to engine RPM. This train of pulses is coupled to the input of integrator 14.

Integrator 14 integrates the pulse train from one-shot multivibrator 12 and produces a DC voltage whose level is proportional to the frequency of the pulse train.

The output of integrator 14 is coupled to the input of voltage comparator 16 of conventional design which operates to compare the voltage level of the output signal from integrator 14, with a source of reference voltage. Voltage comparator 16 operates to provide a minimum DC voltage output when the input voltage level is below the preset voltage reference level, and, conversely, a maximum DC voltage output when the input voltage level is above the preset voltage reference level. The output of voltage comparator 16 is therefore minimum when the system input frequency is below a predetermined frequency and maximum when the input frequency is above the predetermined value.

The output signal from voltage comparator 16 is coupled to the coil of relay 18 with associated normally closed contacts 20. When the amount of signal available to drive the relay is low, contacts 20 remain closed and conversely when the amount of signal available is high contacts 20 are open. As may be observed the relay contacts 20 are connected in series with the engine compartment exhaust blower 22 and the blower voltage supply, V+.

From the above it will be seen that power is supplied to the system blower 22 until such time as engine RPM's exceed a predetermined minimum value. At that time the blower 22 is automatically turned off until the engine RPM's again fall below the minimum value.

In this configuration the automatic blower control is "fail-safe" in that should the control unit fail, the normally closed contacts 20 will remain closed and the exhaust blower 22 will operate continuously while the engine is operated.

When the blower switch 24 is closed, battery power is applied to the exhaust blower 22 and a voltage is also applied to a timer circuit 26 which will be more fully described hereinbelow. The timer circuit 26 produces an output only after predetermined time after the blower switch 24 has been closed. A relay coil 28 is coupled to the output of the timer circuit 26 and has a set of normally open contacts 30 coupled in series in the engine starter solenoid circuit. Only after the exhaust blower 22 has operated for a predetermined period of time will the relay coil 28 be energized, closing contacts 30 and completing the starter solenoid circuit. Being coupled in series with the starter solenoid circuit rather than the engine ignition circuit, a failure in the timing circuit after the engine has been started will not interfere with the continued operation of the engine.

Switch 32 is a spring loaded, normally open, manually operable emergency override switch which permits the operator to override the timing circuit and start the engine without delay when such action is dictated by the circumstances. Operation of the emergency override switch 32 does, however, require a conscious operator decision since the switch 32 must be depressed simultaneously with operation of the engine starter switch as will be more fully explained with reference to FIG. 2. The switch 32, being repeatedly operable, permits periodic testing to insure reliable operation when an emergency situation is actually encountered.

Figure 2:
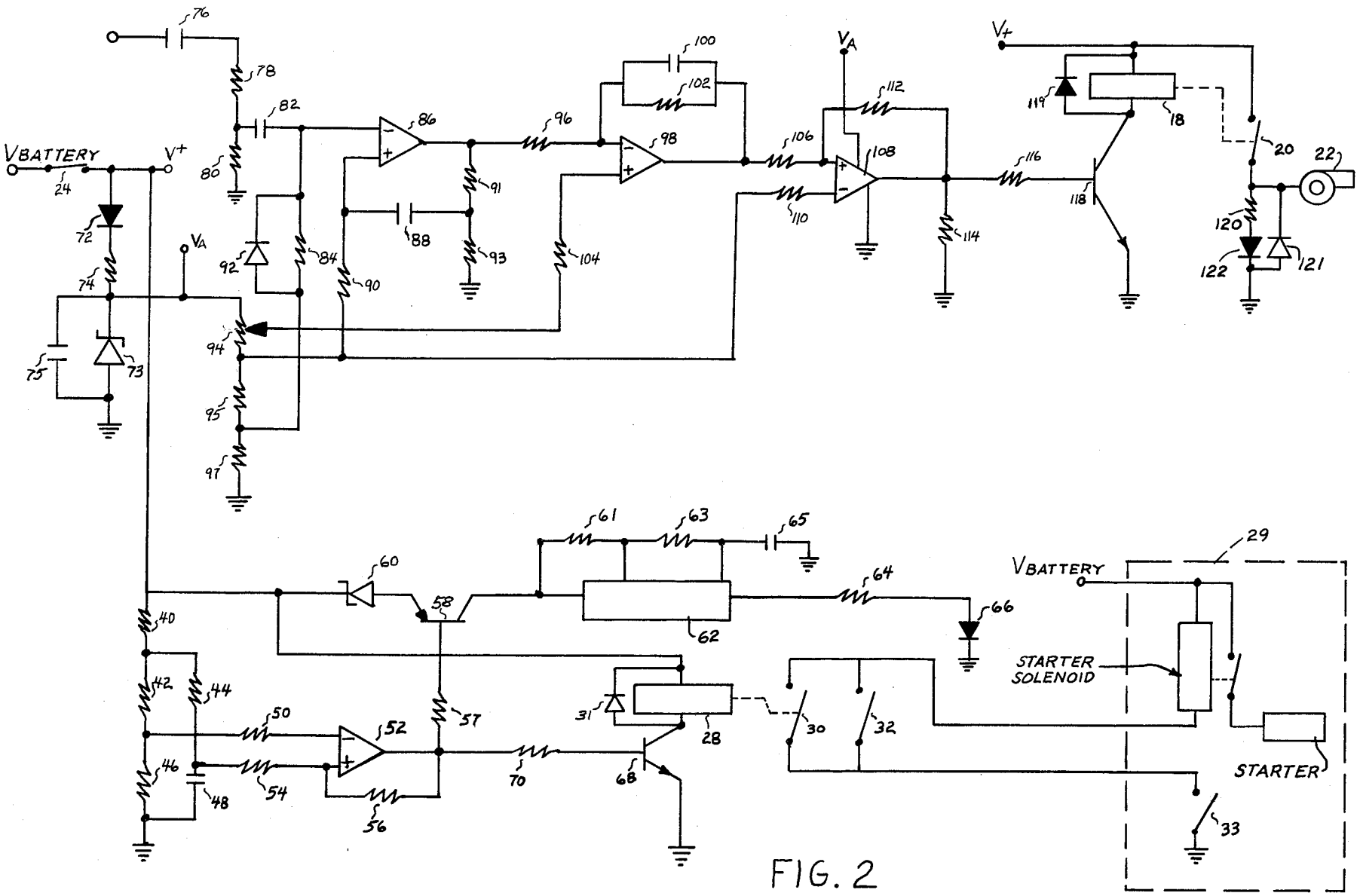
FIG. 2 is a more detailed circuit diagram of the system of FIG. 1.

Turning now to FIG. 2 there is shown a more detailed circuit diagram of the apparatus of FIG. 1. The power input V+ from the vessel's battery is coupled to the system through blower switch 24 and to the exhaust blower 22 through normally closed contacts 20. When the blower switch 24 is activated V+ power is applied through resistors 40, 42 and 46 to the RC network formed by resistor 44 and capacitor 48. Resistors 40, 42 and 46 form a divider, one junction of which is coupled via resistor 50 to the negative input of operational amplifier 52 to provide a first source of reference d.c. voltage. The positive input of operational amplifier 52 is coupled via resistor 54 to the junction between resistor 44 and capacitor 48 and to its own output via feedback resistor 56. Thus initially the output of operational amplifier 52, applied to the base of transistor 58 through resistor 57, is low and transistor 58 conducts V+ power through zener diode 60 to the input of a conventional solid state timer 62 such as an NE555 timer which is commercially available from National Semiconductor Corp. The resistors 61 and 63 and capacitor 65 coupled to the timer are used to set the flashing frequency of a visual indicator 66. The output of the timer 62 is coupled through resistor 64 to a visual indicator such as a light emitting diode 66. The light emitting diode 66 will thus flash indicating that the starter solenoid circuit through normally open contacts 30 is open.

As capacitor 48 charges through resistor 44 to a preselected level the output of operational amplifier 52 goes high, switching transistor 58 off. Transistor 68 is switched on via resistor 70 allowing current flow through relay coil 28 and closing contacts 30 to complete the standard type starter solenoid circuit 29. Diode 31 operates to prevent negative transients when the relay coil 28 is de-energized.

In the event of a failure of operational amplifier 52, transistor 58 or transistor 68 the exhaust blower 22 remains on, although the starter circuit is open. By use of the emergency override switch 32 in conjunction with the engine starter switch 33 the engine may still be started.

A diode 72 and dropping resistor 74 are used to provide a lower level voltage $V_A$ compatible with the circuitry of the automatic low speed blower control portion of the present invention. The parallel connected zener diode 73 and capacitor 75 are provided to limit and stabilize the generator output voltage when the engine is operating. The input signal from the engine speed sensor 10 of FIG. 1 is applied through capacitor 76 to a first divider comprising resistors 78 and 80 and then coupled through capacitor 82 to the negative input of operational amplifier 86 together with voltage $V_A$ through resistors 94, 95 and 84. The signal is differentiated by capacitor 82 and resistor 84 to provide a positive trigger input signal to the negative input of operational amplifier 86, configured as a one-shot multivibrator. The positive input of operational amplifier 86 is coupled to voltage $V_A$ through resistors 94 and 90 with capacitor 88 and resistor 90 providing output pulse width control. Diode 92 operates to reject the negative portion of the input signal and the divider consisting of resistors 91 and 93 serves to remove ripple from the multivibrator output and prevent the positive input from going negative.

The output of operational amplifier 86 is coupled through resistor 96 to the negative input of operational amplifier 98 configured as an inverting integrator. The input signal from the one-shot multivibrator is integrated with the appropriate time constants determined by the values of capacitor 100 and resistor 96 with a discharge path being provided by resistor 102. The positive input of operational amplifier 98 is coupled via resistor 104 to the wiper of variable resistor 94 thus providing a voltage reference for setting the integrator output levels with respect to the input frequency. The integrated output is coupled from operational amplifier 98 through resistor 106 to the positive input of operational amplifier 108 configured as a voltage comparator. Resistors 112 and 114 serve to establish the desired amount of hysteresis in order that the comparator output signal is solidly high or low and will not oscillate at the turn-on and turn-off levels. A second source of reference d.c. voltage for establishing the on and off points of operation is determined by the values of resistors 94, 95 and 97. Resistor 110 provides input biasing to the negative input of operational amplifier 108.

The comparator output is coupled through resistor 116 to the base of npn transistor 118, the collector of which is coupled through relay coil 18 to V+ and the emitter to ground. When the comparator output is high, transistor 118 is switched on and relay coil 18 is energized thus opening the normally closed contacts 20. During low speed engine operation the comparator output is low, transistor 118 switches off de-energizing relay coil 18 and allowing contacts 20 to close actuating the exhaust blower 22. Diode 119 serves to prevent negative transients on de-energizing relay coil 18 as does diode 121. V+ is also coupled through resistor 120 to light emitting diode 122 thus indicating to the operator that the exhaust blower 22 is operating.

It will be seen that a failure in the low speed blower actuation circuitry will result in the contacts 20 remaining closed such that the exhaust blower operation will be continuous thus preventing fume buildup even in the failure mode.

From the foregoing discussion it will be understood that the applicant has provided a new and novel automatic blower control system for inboard marine engines whereby the objectives set forth hereinabove are efficiently met. Since certain changes in the above-described construction will occur to those skilled in the art without departure from the scope of the invention it is intended that all matter set forth in the preceeding description or shown in the appended drawings shall be interpreted as illustrative and not in a limiting sense.

Having described what is new and novel and desired to secure by Letters Patent, what is claimed is:

1. An automatic blower control system for use in combination with an inboard marine engine having associated therewith an exhaust blower for ventilating the compartment in which said engine is disposed, a power source for said blower, a blower switch coupled between said blower and said power source, and an engine starting circuit including a starter solenoid circuit, said system comprising first switching means having normally open contacts coupled in series with said starter solenoid circuit and having a control input;

means coupled between said blower switch and said starter solenoid circuit for providing a voltage proportional to time elapsed from the time said blower switch is closed, a first source of reference d.c. voltage, an operational amplifier having a first input coupled to said first source of reference d.c. voltage, a second input coupled to said means for providing said time proportional voltage, and operating to produce a relatively higher output only when said time proportional voltage exceeds said first reference d.c. voltage whereby said starter solenoid circuit is completed only after the expiration of a predetermined period of time after said blower switch is closed;

sensing means associated with said engine and operating in response to operation of said engine to generate an output signal having a frequency proportional to the speed of said engine;

a one-shot multivibrator coupled at its input to the output of said sensing means, and operating to produce at its output a pulsed signal of fixed pulse amplitude fixed pulse width and a frequency directly proportional to the frequency of said sensing means output signal;

an integrator coupled at its input to the output of said multivibrator and operating to produce at its output a d.c. voltage of a level directly proportional to the frequency of said multivibrator output signal;

a second source of reference d.c. voltage of a level directly proportional to a preselected minimum speed of said engine;

a voltage comparator having first and second inputs, said first input being coupled to said second source of reference d.c. voltage, said second input being coupled to the output of said integrator, and operating to produce at the output thereof a maximum d.c. voltage level when the voltage level at said second input is relatively higher than the voltage level at said first input and a minimum d.c. voltage level when the voltage level at said second input is relatively lower than the voltage level at said first input;

second switching means having normally closed contacts coupled in series between said exhaust blower and said power source for said blower and a control input coupled to the output of said voltage comparator such that said normally closed contacts remain closed in response to a minimum d.c. voltage coupled to said control input and open in response to a maximum d.c. voltage coupled to said control input whereby said exhaust blower is automatically actuated when the speed of said engine falls below said preselected minimum speed; and third switching means having normally open, manually operable contacts coupled in parallel with said first switching means whereby said starter solenoid circuit may be manually completed prior to the expiration of said predetermined period of time.

2. An automatic blower control system as recited in claim 1 wherein said first switching means comprises an npn transistor having a base coupled to the output of said operational amplifier, an emitter coupled to ground potential and a collector; and a relay having normally open contacts coupled in series with said starter solenoid circuit, and a coil coupled at one side to the collector of said transistor and at the other side to said blower switch.

3. An automatic blower control system as recited in claim 1 and further including first visual indication means coupled to said operational amplifier and to said blower switch for indicating operation of said exhaust blower during said predetermined period of time; and second visual indication means coupled in parallel with said exhaust blower to said second switching means for indicating operation of said exhaust blower.

4. An automatic blower control system as recited in claim 3 wherein said first visual indication means comprises a pnp transistor having a base coupled to the output of said operational amplifier, an emitter coupled to said blower switch, and a collector; and a light emitting diode coupled between said collector and ground potential such that when the output of said operational amplifier is relatively low said light emitting diode is actuated.

5. An automatic blower control system as recited in claim 4 and further including a solid state timing circuit coupled between the collector of said transistor and said light emitting diode for intermittently interrupting the power applied to said light emitting diode at a preselected frequency.

6. An automatic blower control system as recited in claim 1 wherein said second source of reference d.c. voltage comprises a first voltage divider coupled between said blower switch and ground potential.

7. An automatic blower control system as recited in claim 1 wherein said first source of reference d.c. voltage comprises a second voltage divider coupled between said blower switch and ground potential.

* * * * *